United States Patent [19]

Laitem et al.

[11] Patent Number: 4,753,748

[45] Date of Patent: Jun. 28, 1988

[54] NONAQUEOUS LIQUID AUTOMATIC DISHWASHING DETERGENT COMPOSITION WITH IMPROVED RINSE PROPERTIES AND METHOD OF USE

[75] Inventors: Leopold Laitem, Lebanon, N.J.; Mayriam Delvaux, Hannut, Belgium; Guy Broze, Grace-Hollogne, Belgium; Danielle Bastin, Soumagne, Belgium

[73] Assignee: Colgate-Palmolive Company, New York, N.Y.

[21] Appl. No.: 901,221

[22] Filed: Aug. 28, 1986

[51] Int. Cl.[4] ..... C11D 3/075; C11D 3/39; C11D 17/00

[52] U.S. Cl. ..... 252/99; 252/102; 252/135; 252/174.12; 252/174.21; 252/174.19; 252/DIG. 14

[58] Field of Search ..... 252/99, 95, 174.21, 252/135, 174.22, 102, 174.12, 174.19

[56] References Cited

U.S. PATENT DOCUMENTS

| | | | |
|---|---|---|---|
| 3,850,831 | 11/1974 | Hellsten et al. | 252/99 |
| 4,115,308 | 9/1978 | Guerry | 252/135 |
| 4,264,466 | 4/1981 | Carleton et al. | 252/99 |
| 4,326,979 | 4/1982 | Bus et al. | 252/158 |
| 4,615,820 | 10/1986 | Hepworth et al. | 252/139 |
| 4,622,173 | 11/1986 | Broze et al. | 252/528 |
| 4,647,393 | 3/1987 | Onhadi et al. | 252/102 |
| 4,648,983 | 3/1987 | Broze et al. | 252/135 |

FOREIGN PATENT DOCUMENTS

| | | |
|---|---|---|
| 1112534 | 11/1981 | Canada . |
| 2158838 | 11/1985 | United Kingdom . |

*Primary Examiner*—Prince E. Willis

*Attorney, Agent, or Firm*—M. M. Grill; N. Blumenkopf

[57] ABSTRACT

A nonaqueous liquid automatic dishwashing detergent composition with improved rinse properties and method of using the detergent composition. The dishwashing composition comprises a liquid nonionic surfactant containing a stable or readily redispersible suspension of polyphosphate builder salt.

21 Claims, No Drawings

NONAQUEOUS LIQUID AUTOMATIC DISHWASHING DETERGENT COMPOSITION WITH IMPROVED RINSE PROPERTIES AND METHOD OF USE

FIELD OF THE INVENTION

This invention relates to a nonaqueous liquid automatic dishwashing detergent composition with improved rinse properties and method of using the detergent composition to wash dishes, glasses, cups and eating utensils.

The dishwashing composition comprises a highly concentrate liquid non ionic surfactant containing a stable or readily redispersible suspension of polyphosphate and other builder salts.

The detergent compositions of the present invention do not require an added rinse aid, are stable in storage, do not settle or are readily redispersible and are pourable.

PRIOR ART

At the present time only powder dishwashing detergent compositions are being commercially marketed. The powder detergents have several disadvantages. They are difficult to accurately measure, they cannot incorporate ingredients in their formations which cannot stand the drying temperatures at which powder detergents are subjected without deterioration and in storage frequently cake and harden. The powder detergents also suffer the disadvantage of requiring the addition of a rinse aid to the formulation or during the rinse cycle.

The presently used formulated powder detergents frequently require a separate step of hand towel wiping and drying of the dishes, glasses, cups and utensils to avoid leaving undesirable traces or film of precipitated calcium and magnesium salts.

The use of concentrated liquid detergents compositions present other problems. The builder salts settle in storage and are not readily redispersed. The concentrates in storage become thicker and are not readily pourable and form gels.

The tendency of concentrated detergent compositions to gel during storage is aggrevated by storing the compositions in unheated storage areas, or by shipping the compositions during winter months in unheated transportation vehicles.

The concentrated non aqueous liquid automatic dishwashing detergent composition of the present invention overcome many of the prior art problems. Because of the concentrated nature of the composition there is sufficient amount of the liquid non ionic surfactant and there is sufficient amount of builder salt remaining after the dishwashing wash cycle to during the rinse cycle react with any calcium or magnesium ions in hard rinse water such that an added rinse aid is not required and towel drying is not required to obtain dry sparkling clean dishes, glasses, cups and eating utensils.

The concentrated non aqueous liquid automatic dishwashing detergent compositions in a preferred embodiment have the additional advantages of being stable, non settling in storage, and non gelling in storage or are readily redispersible. The liquid compositions of the present invention are easily pourable, easily measured and easily put into dishwashing machines.

Further, because the dishwashing machines are built and marketed have a built in volume space in which the detergent is placed, the highly concentrated nature of the liquid detergent composition of the present invention allows placing in the dishwashing machine more active liquid non ionic surfactant detergent and more dispersed polyphosphate and other detergent builders.

The related pending applications assigned to the common assignee are Ser. No. 687,815 filed Dec. 31, 1984; Ser. No. 597,948 filed Apr. 8, 1984; and Ser. No. 597,793 filed Apr. 6, 1984.

A difference in these three applications from the instant application is that they are directed to laundry detergent compositions rather than dishwashing detergent compositions. It is known and recognized in the art that laundry detergent compositions do not have the same problems as dishwashing compositions, e.g. that of leaving unsightly traces or film on dishes, glasses, cups and eating utensils. Further, the washing of dishes is not carried out in the same manner as the washing of laundry, e.g. does not involve tumble washing and extended direct contact with the detergent composition.

BRIEF DESCRIPTION OF THE INVENTION

In accordance with the present invention a highly concentrated non aqueous liquid automatic dishwashing detergent composition with improved rinse properties is prepared by dispersing a polyphosphate builder in a low foam liquid nonionic surfactant detergent. The polyphosphate builder may be replaced in whole or in part by other detergent builders such as alkali metal citrates or tartrates.

In order to improve the viscosity characteristics of the composition an acid terminated non ionic surfactant may be added. To further improve the viscosity characteristics of the composition and the storage properties of the composition there can be added to the composition viscosity improving and anti gel agents such alkylene glycol mono alkyl ethers and anti settling agents such as phosphoric acid esters.

Sanitizing or bleaching and oxydizing agents can be added to improve the cleansing characteristics of the composition.

In addition other ingredients can be added to the composition such as anti-encrustation agents, anti-foam agents, optical brighteners, enzymes and perfume.

In a preferred embodiment of the invention the builder components of the composition are ground to a particle size of less than 100 microns and to preferrable less than about 10 microns to further improve the stability of the suspension of the builder components in the liquid non ionic surfactant detergent.

The presently manufactured and sold dishwashers for home use are normally operated at washing temperatures of 60° C. and rinse temperatures of 60° C. About 2.6 gallons (10 liters) of water are used during the dishwashing and rinse cycles.

About 60 gms of powder detergent per wash is normally used.

In accordance with the present invention where the highly concentrated liquid detergent is used normally only 40 gms (35 cc) of the liquid detergent is required to wash and rinse a full load of dirty dishes, glasses, cups and/or utensils.

ADVANTAGES OVER PRIOR ART

The present invention overcomes many of the prior art problems associated with powder detergents. For example, less of the concentrated liquid detergent is required, an added rinse aid is not required and towel wiping and drying are not required.

The concentrated liquid nonaqueous surfactant detergent compositions of the present invention are stable in storage, easily pourable and readily disperse in the dishwashing water.

OBJECTS OF THE PRESENT INVENTION

It is an object of the invention to provide a concentrated nonaqueous liquid automatic dishwashing detergent composition that has improved rinse properties.

It is another object of the invention to provide a concentrated nonaqueous liquid automatic dishwashing detergent composition to which a separate rinse aid is not added or needed.

It is another object of the invention to provide a nonaqueous liquid automatic dishwashing detergent composition which is stable in storage, easily pourable and readily dispersible in the dishwashing water.

A further object of the invention is to provide a method of washing dishes, glasses, cups and eating utensils in an automatic dishwashing machine using a concentrated nonaqueous liquid detergent composition in which a separate rinse aid is not added or needed.

A still further object of the invention is to provide a method of washing dishes, glasses, cups and eating utensils in an automatic dishwashing machine using a concentrated nonaqueous liquid detergent composition by which method the dishes, glasses, cups and eating utensils are machine dried without leaving traces or a film.

DETAILED DESCRIPTION OF THE INVENTION

Liquid Nonionic Surfactant Detergents

The liquid non ionic surfactant detergents that can be used in the practice of the present are well known. A wide variety of the known surfactants can be used.

As is well known, the nonionic synthetic organic detergents are characterized by the presence of an organic hydrophobic group and an organic hydrophilic group and are typically produced by the condensation of an organic aliphatic or alkyl aromatic hydrophobic compound with ethylene oxide (hydrophilic in nature). Practically any hydrophobic compound having a carboxy, hydroxy, amido or amino group with a free hydrogen attached to the nitrogen can be condensed with ethylene oxide or with the polyhydration product thereof, polyethylene glycol, to form a nonionic detergent. The length of the hydrophilic or polyoxy ethylene chain can be readily adjusted to achieve the desired balance between the hydrophobic and hydrophilic groups. Typical suitable nonionic surfactants are those disclosed in U.S. Pat. Nos. 4,316,812 and 3,630,929.

Preferably, the nonionic detergents that are used are the low foam poly-lower alkoxylated lipophiles wherein the desired hydrophile-lipophile balance is obtained from addition of a hydrophilic poly-lower alkoxy group to a lipophilic moiety. A preferred class of the nonionic detergent employed is the poly-lower alkoxylated higher alkanol wherein the alkanol is of 9 to 18 carbon atoms and wherein the number of mols of lower alkylene oxide (of 2 or 3 carbon atoms) is from 3 to 12. Of such materials it is preferred to employ those wherein the higher alkanol is a higher fatty alcohol of 9 to 11 or 12 to 15 carbon atoms and which contain from 5 to 8 or 5 to 9 lower alkoxy groups per mol. Preferably, the lower alkoxy is ethoxy but in some instances, it may be desirably mixed with propoxy, the latter, if present, usually being a minor (less than 50%) portion. Exemplary of such compounds are those wherein the alkanol is of 12 to 15 carbon atoms and which contain about 7 ethylene oxide groups per mol.

Useful nonionics are represented by the low foam Plurafac series from BASF Chemcial Company which are the reaction product of a higher linear alcohol and a mixture of ethylene and propylene oxides, containing a mixed chain of ethylene oxide and propylene oxide, terminated by a hydroxyl group. Examples include Product A (A $C_{13}$–$C_{15}$ fatty alcohol condensed with 6 moles ethylene oxide and 3 moles propylene oxide). Product B (a $C_{13}$–$C_{15}$ fatty alcohol condensed with 7 moles propylene oxide and 4 moles ethylene oxide), and Product C (a $C_{13}$–$C_{15}$ fatty alcohol condensed with 5 moles propylene oxide and 10 moles ethylene oxide). Another group of low foam liquid nonionics are available from Shell Chemical Company, Inc. under the Dobanol trademark: Dobanol 91-5 is a low foam ethoxylated $C_9$–$C_{11}$ fatty alcohol with an average of 5 moles ethylene oxide and Dobanol 25-7 is an ethoxylated $C_{12}$–$C_{15}$ fatty alcohol with an average of 7 moles ethylene oxide.

Another low foam liquid nonionic surfactant that can be used is sold under the tradename Lutensol SC 9713.

Other useful surfactants are Neodol 25-7 and Neodol 23-6.5, which products are made by Shell Chemical Company, Inc. The former is a condensation product of a mixture of higher fatty alcohols averaging about 12 to 15 carbon atoms, with about 7 mols of ethylene oxide and the latter is a corresponding mixture wherein the carbon atom content of the higher fatty alcohol is 12 to 13 and the number of ethylene oxide groups present averages about 6.5. The higher alcohols are primary alkanols. Other examples of such detergents include Tergitol 15-S-7 and Tergitol 15-S-9 (registered trademarks), both of which are linear secondary alcohol ethoxylates made by Union Carbide Corp. The former is mixed ethoxylation product of 11 to 15 carbon atoms linear secondary alkanol with seven mols of ethylene oxide and the latter is a similar product but with nine mols of ethylene oxide being reacted.

Also useful in the present compositions as a component of the nonionic detergent are higher molecular weight nonionics, such as Neodol 45-11, which are similar ethylene oxide condensation products of higher fatty alcohols, with the higher fatty alcohol being of 14 to 15 carbon atoms and the number of ethylene oxide groups per mol being about 11. Such products are also made by Shell Chemical Company.

In the preferred poly-lower alkoxylated higher alkanols, to obtain the best balance of hydrophilic and lipophilic moieties the number of lower alkoxies will usually be from 40% to 100% of the number of carbon atoms in the higher alcohol, preferably 40 to 60% thereof and the nonionic detergent will preferably contain at least 50% of such preferred poly-lower alkoxy higher alkanol.

Mixtures of two or more of the liquid nonionic surfactants can be used and in some cases advantages can be obtained by the use of such mixtures.

Acid Terminated Liquid Nonionic Surfactant Detergents

The viscosity properties of the liquid nonionic surfactant detergent that is used can be improved by including in the composition an acid terminated liquid nonionic surfactant detergent. The acid terminated nonionic surfactants preferably consist of a low foam nonionic surfactant which has been modified to convert a free hydroxyl group thereof to a moiety having a free carboxyl group, such as a partial ester of a nonionic surfactant and a polycarboxylic acid or anhydride.

The addition of the acid terminated nonionic surfactants to the liquid nonionic surfactant aids in the dispensibility of the composition, i.e. pourability, and lowers the temperature at which the liquid nonionic surfacts form a gel in water. The acid terminated nonionic surfactant reacts in the dishwashing machine water with the alkalinity of the dispersed builder salt phase of the detergent composition and acts as an effective anionic surfactant.

The acid terminated nonionic surfactants are esters of the nonionic surfactant and the polycarboxylic acid. Specific examples include the half-esters of Product A with succinic anhydride, the ester or half ester of Dobanol 25-7 with succinic anhydride, and the ester or half ester of Dobanol 91-5 with succinic anhydride. Instead of succinic anhydride, other polycarboxylic acids or anhydrides can be used, e.g. maleic acid, maleic acid anhydride, glutaric acid, malonic acid, succinic acid, phthalic acid, phthalic anhydridge, citric acid and the like.

The use of the low foam nonionic surfactants in the formulations is important in avoiding cavitation problems during the wash cycle. The use of the low foam nonionic surfactants is accordingly preferred.

The acid terminated nonionic surfactants can be prepared as follows:

Acid Terminated Products A. 400 g of Product A low foam nonionic surfactant which is a $C_{13}$ to $C_{15}$ alkanol which has been alkoxylated to introduce 6 ethyleneoxide and 3 propylene oxide units per alkanol unit is mixed with 32 g of succinic anhydride and heated for 7 hours at 100° C. The mixture is cooled and filtered to remove unreacted succinic material. Infrared analysis indicates that about one half of the nonionic surfactant has been converted to the acidic half ester thereof.

Acid Terminated Dobanol 25-7. 522g of Dobanol 25-7 nonionic surfactant which is the product of ethoxylation of a $C_{12}$ to $C_{15}$ alkanol and has about 7 ethyleneoxide units per molecule of alkanol is mixed with 100 g of succinic anhydride and 0.1g of pyridine (which acts as an esterification catalyst) and heated at 260° C. for 1 hours, cooled and filtered to remove unreacted succinic material. Infrared analysis indicates that substantially all the free hydroxyls of the surfactant have reacted.

Acid Terminate Dobanol 91-5. 1000 g of Dobanol 91-5 low foam nonionic surfactant which is the product of ethoxylation of a $C_9$ to $C_{11}$ alkanol and has about 5 ethylene oxide units per molecule of alkanol is mixed with 100g of succinic anhydride and 0.1g of pyridine catalyst and heated at 260° C. for 2 hours, cooled and filtered to remove unreacted succinic material. Infrared analysis indicates that substantially all the free hydroxyls of the surfactant have reacted. Other esterification catalysts, such as an alkali metal alkoxide (e.g. sodium methoxide) may be used in place of, or in admixture with, the pyridine.

The low foam nonionic surfactants are preferably used to prepare the acid terminated nonionic surfactants.

BUILDER SALTS

The liquid non aqueous nonionic surfactant has dispersed therein fine particles or organic and/or inorganic detergent builders.

A preferred solid builder salt is an alkali metal polyphosphate such as sodium tripolyphosphate ("TPP"). In place of all or part of the alkali metal polyphosphate one or more other detergent builder salts can be used. Suitable other builder salts are alkali metal carbonates, borates, phosphates, bicarbonates, silicates, lower polycarboxylic acid salts, and polyacrylates, polymaleic anhydrides and copolymers of polyacrylates and polymaleic anhydrides and polyacetal carboxylates.

Specific examples of such builders are sodium carbonate, sodium tetraborate, sodium pyrophosphate, potassium pyrophosphate, sodium bicarbonate, sodium hexametaphosphate, sodium sesquicarbonate, sodium mono and diorthophosphate and potassium bicarbonate. The builder salts can be used alone with the nonionic surfactant or in admixture with other builders. Typical builders also include those disclosed in U.S. Pat. Nos. 4,316,812, 4,264,466 and 3,630,929 and those disclosed in U.S. Pat. Nos. 4,144,226, 4,135,092 and 4,146,495.

A more detailed description of some of the preferred builders follows.

Sodium Tripolyphosphate (TPP)

The TPP is a preferred builder salt. The TPP is a blend of anhydrous TPP and a small amount of TPP hexahydrate such that the chemically bound water content is about 1%, which corresponds to about one $H_2O$ per pentasodium tripolyphosphate molecule. Such TPP may be produced by treating anhydrous TPP with a limited amount of water. The presence of the hexahydrate slows down the rapid rate of solution of the TPP in the wash bath and inhibits caking. One suitable TPP is sold under the name Thermphos NW. The particles size of the Thermphos NW TPP, as supplied, is usually averages about 200 microns with the largest particles being about 400 microns.

Alkali Polycarboxylic Acids

Since the compositions of this invention are generally highly concentrated, and, therefore, may be used at relatively low dosages, it is desirable to supplement any phosphate builder (such as sodium tripolyphosphate) with an auxiliary builder such as an alkali metal polycarboxylic acid having high calcium binding capacity to inhibit encrustation which could otherwise be caused by formation of an insoluble calcium phosphate. Suitable alkali metal polycarboxylic acids are alkali metal salts of citric and tartaric acid, e.g. monosidum citrate (anhydrous). The alkaline earth, e.g. calcium and magnesium salts of polycarboxylic acids are very soluble in water. The high solubility, for example, calcium citrate improves significantly the rinse properties of the detergent composition. Because of the highly concentrated nature of the detergent composition, there is sufficient detergent capacity to clean the dishes and to allow a sufficient remaining quantity of detergent to react with additional hard rinse water and the calcium and magneisum salts to maintain the calcium and magneisum in solution and remove them from the dishwaster rather than have the calcium and magnesium precipitate as insoluble phosphate salts and leave unpleasant traces and film on the dishes, glasses and utensils.

Polyacrylates and Polymaleic Anhydrides

A suitable organic builder consists of a copolymer which is the reaction product of about equal moles of methacrylic acid and maleic anhydride which has be completely neutralized to form the sodium salt thereof. The builder is commercially available under the tradename of Sokalan CP5. This builder serves to inhibit encrustation, i.e. also inhibits the formation and precipitation of dicalcium phosphate.

Alkali Metal Silicates

The alkali metal silicates are useful builder salts which also function to make the composition anti-corrosive to eating utensils and to automatic dishwashing machine parts. sodium silicates of $Na_2O/SiO_2$ ratios of from 1.6/1 to 1/3.2 especially about 1/1 to 1/2.8 are preferred. Potassium silicates of the same ratios can also be sued. The preferred alkali metal silicates are sodium disilicate and sodium metal silicate.

Zeolite Builders

Another class of builders useful herein are the water insoluble aluminosilicates, both of the crystalline and amorphous type. Various crystalline zeolites (i.e. alumino-silicates) are described in British Patent No. 1,504,168, U.S. Pat. No. 4,409,136 and Canadian Patent Nos. 1,072,835 and 1,087,477. An example of amorphous zeolites useful herein can be found in Belgium Patent No. 835,351. The zeolites generally have the formula $$(M_2O)_x\,(Al_2O_3)_y\,(SiO_2)_z\,wH_2O$$

wherein x is 1, y is from 0.8 to 1.2 and preferably 1, z is from 1.5 to 3.5 or higher and preferably 2 to 3 and w is from 0 to 9, preferably 2.5 to 6 and M is preferably sodium. A typical zeolite is type A or similar structure, with type 4A particularly preferred. The preferred aluminosilicates have calcium ion exchange capacities of about 200 milliequivalents per gram or greater, e.g. 400 meq/g.

Stabilizing And Viscosity Control Agents

The stability against settling properties can be improved by the addition to the composition of a small effective amount of phosphoric ester and the viscosity and anti-gel properties of the composition can be improved by adding to the composition an effective amount of an alkylene glycol monoalkyl ether.

Phosphoric Acid Ester

In accordance with an embodiment of the present invention the stability of the suspension is increased by including in the composition an acidic organic phosphorus compound having an acidic —POH group. The use of organic phosphoric acid esters as stabilizing additives to nonionic laundry detergent compositions containing polyphosphate builders is disclosed in the commonly assigned copending application Ser. No. 597,793 filed Apr. 6, 1984.

The acidic organic phosphorus compound may be, for instance, a partial ester of phosphoric acid and an alcohol such as an alkanol which has a lipophilic character, having, for instance, more than 5 carbon atoms, e.g. 8 to 20 carbon atoms. A specific example is a partial ester of phosphoric acid and a $C_{16}$ to $C_{18}$ alkanol (Empiphos 5632 from Marchon); it is made up of about 35% monoester and 655 diester. The inclusion of quite small amounts of the acidic organic phosphorus compound makes the suspension significantly more stable against settling on standing but remains pourable and decreases its plastic viscosity. It is believed that the use of the acidic phosphorus compound may result in the formation of a high energy physical bond between the —POH portion of the molecule and the surfaces of the inorganic polyphosphate builder so that these surfaces take on an organic character and become more capatible with the nonionic surfactant.

Alkylene glycol Mono Alkyl Ether

The inclusion in the detergent composition of the present invention of an effective amount of a lower ($C_2$ to $C_3$) alkylene glycol mono (lower) ($C_1$ to $C_5$) alkyl ether decreases the viscosity of the composition, such that it is more easily pourable, improves the stability against settling and improves the dispensibility of the composition on addition to water in the dishwashing machine. More specifically the alkylene glycol mono alkyl ether is a low moleculare wieght amphiphilic compound, particularly a mono-, di- or tri lower ($C_2$ to $C_3$) alkylene glycol mono lower ($C_1$ to $C_5$) alkyl ether. Suitable examples of such additive amphiphilic compounds are ethylene glycol monoethyl ether ($C_2H_5$—O—($CH_2CH_2OH$), diethylene glycol monobutyl ether ($C_4H_9$—O—$(CH_2CH_2O)_2H$) and dipropylene glycol monomethyl ether $$(CH_3{-}O{-}(CH_2\underset{\underset{CH_3}{|}}{C}HO)_2H).$$

The compositions of the present invention have improved viscosity and stability characteristics and remain stable and pourable at temperature as low as about 5° C. and lower.

Bleaching or Oxidizing Agents

The detergent composition of the present invention preferably includes a peroxygen or chlorine bleaching agent. The oxygen bleaching agents that can be used are alkali metal perborate, percarbonate or perphosphate. Particularly suitable compounds are sodium and potassium perborates, percarbonate and perphosphates, and potassium monopersulfate. A preferred compound is sodium perborate monohydrate. The chlorine bleaching agents that can be used are sodium hypochlorite (NaOCl), potassium dichloroisocyanurate (59% available chlorine), and trichloroisocyanuric acid (85% available chlroine).

Activators

The peroxygen bleaching compound is preferably used in admixture with an activator therefor. Suitable activators are those disclosed in U.S. Pat. No. 4,264,466 or incolumn 1 of U.S. Pat. No. 4,430,244. Polyacylated compounds are preferred activators. Suitable preferred activators are tetraacetyl ethylene diamine ("TAED") and pentaacetyl glucose.

Sequestering Agents

The activator usually interacts with the peroxygen compound to form a peroxyacid bleaching agent in the wash water. It is preferred to include a sequestering agent of high complexing power to inhibit any undesired reaction between such peroxyacid and hydrogen peroxide in the wash solution in the presence of metal ions. Suitable sequestering agents include the sodium salts of nitroilotriacetic acid (NA), ethylene diamine tetraacetic acid (EDTA), diethylene triamine pentaacetic acid (DETPA), diethylene triamine pentamethylene phosphonic acid (DTPMP) sold under the tradename DEQUEST 2066 and ethylene diamine tetramethylene phosphonic acid (EDITEMPA). The sequestering agents can be used alone or in admixture.

Other Ingredients

Various other detergent additives or adjuvants may be included in the composition of the present invention to give it additional desired properties, either of functional or aesthetic nature. Thus, there may be included in the formulation small amounts of enzymes, such as proteolytic enzymes, such as subtilism, bromelin, papin, trypsin and pepsin, as well as amylolytic enzymes, such as amylase type enzymes, lipase type enzymes, and mixtures, for example protease slurry and amylase enzymes. Preferred enzymes are the amylolytic enzymes which are available under the name Termamyl.

Anti-foam agents such as Silicane L 7604, which s a polysiloxane, and perfumes, e.g. lemon perfume can be included.

The composition may also include conventional organic or inorganic thixotropic thickening agents in amounts sufficient to obtain a product consistency of a cream or a paste.

The thixotropic thickening agents, i.e. thickeners or suspending agents which provide thixotropic properties, are known in the art and may be organic or inorganic water soluble, water dispersible or colloid-forming, and monomeric or polymeric, and should of course be stable in these compositions, e.g stable to alkalinity and bleach compounds, such as sodium perborate. The preferred thickeners generally comprise the inorganic, colloid-forming clays of smectite and/or attapulgite types. These materials are generally used in amount of about 1.5 to 10, preferably 2 to 5 wt %, to confer the desired thixotropic properties to the formulation.

Smectite clays include montmorillonite (bentonite), hectorite, attapulgite, smectite, saponite, and the like. Montmorillonite clays are preferred and are available under tradenames such as Thixogel (Registered Trademark) No. 1 and Gelwhite (Registered Trademark) GP, H, etc., from Georgia Kaolin Company; and ECCAGUM (Registered Trademark) GP, H, etc., from Luthern Clay Products. Attapulgite clays include the materials commercially available under the tradename Attagel (Registered Trademark), i.e. Attagel 40, Attgel 50 and Attagel 150 from Engelhard Minerals and Chemicals Corporation. Mixtures of smectite and attapulgite types in weight ratios of 4:1 to 1:5 are also useful. Thickening or suspending agents of the foregoing types are well knonw in the art, being described, for example, in U.S. Pat. No. 3,985,668.

The conventionally used organic polymeric thixotropic thickening agents can also be used.

Description of Conditions

The liquid phase can comprise a mixture of nonionic surfactant and acid terminated nonionic surfactant in the range of about 30 to 70%, such as about 35 to 65% of the formulation.

The nonionic surfactant can comprise about 30 to 60%, such as about 35 to 55% of the formulation.

The acid terminated nonionic surfactant can comprise about 0 to 20, such as 5 to 20% of the formulation.

The builders are suspended and/or dissolved in the liquid phase and can comprise about 10 to 80%, such as about 20 to 65% of the formulation.

The detergent builder can comprise about 10 to 40, such as about 10 to 35% of the formulation. The alkali metal polyphosphates are preferred.

The alkali metal polycarboxylic acid salt can comprise about 0 to 30%, such as about 5 to 20% of the formulation.

The anti-encrustation agent copolymer of metacrylic acid and maleic anhydride sodium salt, e.g. Sokalan CP5, can comprise about 0 to 6%, such as about 1.5 to 5% of the formulation.

The alkali metal silicate can comprise about 0 to 50%, such as about 5 to 30%, for example 10 to 20% of the formulation.

The phosphoric ester stabilizing agent and alkylene glycol ether anti-gel agent can comprise about 0 to 25%, such as 0.5 to 20% of the formulation. The phosphoric acid ester can comprise about 0 to 3%, such as about 0.25 to 2.0% of the formulation. The alkylene glycol mono alkyl ether can comprise about 0 to 20%, such as about 5 to 15% of the formulation.

The bleaching and oxydizing agent can comprise about 1 to 15%, such as about 2 to 12% of the formulation. The bleaching and oxydizing agent activator can comprise about 1 to 6%, such as about 2 to 5.5% of the formulation. The sequestering agent, e.g. Duquest 2066, can comprise about 0 to 2%, such as 0.25 to 1.0% of the formulation.

The formulation can also include an anti foam agent in the amount of about 0 to 1% such as about 0.25 to 1.05, enzymes in an amount of about 0 to 6%, such as 0.5 to 4.0%, for example 0.5 to 2.0%; and a perfume in an amount of about 0 to 2%, such as 0.25 to 1.05 of the formulation. Each of the amounts of the above ingredients are given in weight percent based on the weight of the entire formulation.

The concentrated nonaqueous liquid nonionic automatic dishwashing detergent compositions of the present invention dispenses readily in the water in the dishwashing machine. The presently used home dishwashing machines have a measured capacity for about 80 cc or 90 grams of detergent. In normal use, for example, for a full load of dirty dishes 60 grams of powdered detergent are normally used.

In accordance with the present invention only 35 cc or 40 gms of the concentrated liquid nonionic detergent composition is needed. The normal operation of an automatic dishwashing machine can involve the following steps or cycles: washing, rinse cycles with cold water and rinse cycles with hot water. The entire wash and rinse cycles require about 120 minutes. The temperature of the wash water is about 50° to 70° C. and the temperature of the rinse water is about 50° to 70° C. The wash and rinse cycles use about 8 to 12 liters of water for the wash cycle and about 8 to 12 liters of water of the rinse cycle.

The highly concentrate nonaqueous liquid automatic dishwashing detergent compositions exhibit excellent cleaning properties and because of the high concentration of the detergent in the composition, the detergent is not totally consumed during the wash cycle or toally eliminated during the rinse cycle such that there is a sufficient amount of detergent remaining during the rinse cycle to substantially improve the rinsing. The washed and dried dishes are free of undesirable traces, deposits or film due to the use of hard water in the rinse cycle.

In an embodiment of the invention the stability of the builder salts in the composition during storage and the dispersibility of the composition in water is improved by grinding and reducing the particle size of the solid builders to less than 100 microns, preferably less than 40 microns and more preferably to less than about 10 microns. The solid builders are generally supplied in particle sizes of about 100, 200 or 400 microns. The nonionic liquid surfactant phase can be mixed with the solid builders prior to carrying out the grinding operation.

In the grinding operation it is preferred that the proportion of solid ingredients be high enough (e.g. at least about 40%, such as about 50%) that the solid particles are in contact with each other and are not substantially shielded from one another by the nonionic surfactant liquid. After the grinding step any remaining liquid nonionic surfactant can be added to the ground formulation. Mills which employ grinding balls (ball mills) or similar mobile grinding elements give very good results. Thus, one may use a labroatory batch attritor having 8 mm diameter steatite grinding balls. For larger scale work a continuously operating mill in which there are 1 mm. or 1.5 mm diameter grinding balls working in a very small gap between a stator and a rotor operating at a relatively high speed (e.g. a CoBall mill0 may be employed; when using such a mill, it is desirable to pass the blend of nonionic surfactant and solids first through a mill which does not effect such fine grinding (e.g. a colloid mill) to reduce the particle size to less than 100 microns (e.g. to about 40 microns) prior to the step of grinding to an average particle diameter below about 10 microns in the continuous ball mill.

In a preferred embodiment the detergent builder particles have a particle size distribution such that no more than about 10% by weight of said particles have a particle size of more than about 10 microns.

In a preferred embodiment of the invention the detergent composition is formulated using the below named ingredients.

| | Weight % |
|---|---|
| Lutensol SC 9713 which is a nonionic surfactant detergent. | 35 to 55 |
| Thermphos NW which is sodium tripolyphosphate (TTP) | 10 to 25 |
| Mono sodium citrate anhydrous. | 5 to 20 |
| Sokalan CP5 which is a copolymer of methacrylic acid and maleic anhydride sodium salt. | 1.5 to 3 |
| Sodium disilicate/sodium metasilicate. | 5 to 15 |
| Dipropylene glycol mono methyl ether stabilizing and anti gel agent. | 0 to 15 |
| Empiphos 5632 which is phosphoric acid alkanol ester stabilizing and anti gel agent. | 0 to 1.0 |
| Sodium perborate monohydrate bleaching and oxidizing agent. | 2 to 4 |
| TEAD which is tetraacetylethylene diamine an activator for the bleaching and oxidizing agent. | 2 to 4 |
| Dequest 2066 which is diethylene triamine pentamethylene phosphonic acid sodium salt (DTPMP) sequestering agent. | 0.25 to 1.0 |
| Silicane L 7604 anti-foam agent. | 0.25 to 1.0 |
| Enzymes. | 0.5 to 2.0 |
| Perfume Lemon. | 0.1 to 0.5 |

In another preferred embodiment of the invention the detergent composition is formulated using the below name ingredients.

| | Weight % |
|---|---|
| Dobanol 91-5 which is a nonionic surfactant detergent. | 30 to 45 |
| Acid Term. Dobanol 91-5 nonionic surfactant which is the ester formed with succinic anhydride. | 5 to 20 |
| Thermphos NW which is sodium tripolyphosphate (TPP). | 25 to 35 |
| Sokalan CP5 which is a copolymer of methacrylic acid and maleic anhydride sodium salt. | 3 to 5 |
| Empiphos 5632 which is phosphoric acid alkanol ester stabilizing and anti gel agent. | 0.5 to 1.5 |
| Sodium preborate monohydrate bleaching and oxidizing agent. | 8 to 11 |
| TEAD which is tetraacetylethylene diamine an activator for the bleaching and oxidizing agent. | 3 to 5.5 |
| Protease slurry which is a proteolytic enzyme. | 0.5 to 1.5 |
| Amylase which is a amylolytic enzyme. | 0.5 to 1.5 |

The concentrated nonaqueous liquid nonionic automatic dishwashing detergent composition of the present invention can as previously mentioned also contain conventional dishwashing detergent composition additives. The formulations can be prepared with commercially available solid powder builders, pregound builders, and/or the formulations can be mixed and if desired ground to a desired particle size.

The present invention is further illustrated by the following examples.

EXAMPLE 1

The concentrated nonaqueous liquid nonionic surfactant detergent composition is formulated from the following ingredients in the amounts specified.

| | Weight. % |
|---|---|
| Lutensol SC 9713 nonionic surfactant. | 40.0 |
| Thermos NW (TPP) sodium tripolyphosphate. | 15.0 |
| Monosodium citrate anhydrous. | 15.0 |
| Sokalan CP5 copolymer of methacrylic acid and maleic anhydride sodium salt. | 2.5 |
| Sodium metasilicate. | 18.0 |
| Empiphos 5632 phosphoric acid alkanol ester. | 0.5 |
| Sodium perborate monohydrate. | 3.0 |
| TAED tetraacetylethylene diamine activator. | 3.0 |
| Dequest 2066 diethylenetriamine pentamethylene phosphonic acid sodium salt (DTPMP). | 0.5 |
| Silicane L 7604 (anti foam agent). | 0.75 |
| Termamyl (enzyme). | 1.5 |
| Perfume lemon. | 0.25 |
| | 100.0 |

EXAMPLE 2

A similar concentrated nonaqueous liquid nonionic surfactant detergent composition to that of Example 1 is formulated from the following ingredients. In this formulation Empiphos 5632 is omitted and dipropylene glycol monomethyl ether is added.

| | Weight. % |
|---|---|
| Lutensol SC 9713 nonionic surfactant. | 39.25 |
| Dipropylene glycol monomethylether. | 10.0 |
| Thermos NW (TPP) sodium tripolyphosphate. | 20.0 |
| Mono sodium citrate anhydrous. | 10.0 |
| Sokolan CP5 copolymer of methacrylic acid and maleic anhydride sodium salt. | 2.0 |
| Sodium disilicate. | 10.0 |
| Sodium perborate monohydrate. | 3.0 |
| TEAD tetraacetylethylene diamine activator. | 3.0 |
| Dequest 2066 diethylenetriamine pentamethylene phosphonic acid sodium salt (DTPMP). | 0.5 |

-continued

| | Weight. % |
|---|---|
| Silicane L7604. | 0.5 |
| Termamyl. | 1.5 |
| Perfume lemon. | 0.25 |
| | 100.0 |

EXAMPLE 3

Another concentrated nonaqueous liquid nonionic surfactant detergent composition is formulated from the following ingredients.

| | Weight. % |
|---|---|
| Dobanol 91-5 nonionic surfactant. | 37.5 |
| Acid Terminated Dobanol 91-5 nonionic surfactant. | 12.5 |
| Thermos NW (TPP) sodium tripolyphosphate. | 29.0 |
| Sokalan CP5 copolymer of methacrylic acid and maleic anhydride sodium salt. | 4.0 |
| Empiphos 5632 phosphoric acid alkanol ester. | 1.0 |
| Sodium perborate monohydrate. | 9.5 |
| TAED tetraacetylethylene diamine activator. | 4.5 |
| Protease slurry | 1.0 |
| Amylase | 1.0 |
| | 100.0 |

Each of the above concentrated formulations is used in an automatic dishwashing machine to wash a load of dishes, glasses and eating utensils. It is found that after the wash cycle there is sufficient detergent remaining during a rinse cycle with hard water to prevent the formation of any undesirable traces or film on the dishes, glasses and eating utensils, such that the dishwater dried dishes, glasses and eating utensils are bright, clean and shiny. It is understood that the foregoing detailed description and examples are given merely by way of illustration and that variations may be made therein without departing from the spirit of the invention.

What is claimed is:

1. A method of cleaning dishes, glasses, cups and eating utensils in an automatic dishwashing machine by washing followed by rinsing which comprises adding to the wash water in said dishwashing machine a concentrated nonaqueous liquid dishwashing composition comprising a nonionic liquid surfactant detergent in an amoutn of about 30 to 60 percent at least one detergent builder dispersed in the nonionic surfactant in an amount of about 10 to 40 percent an alkylene glycol mono alkyl ether anti-gel agent in an amount of about 5 to 15 percent said composition being sufficiently concentrated to wash said dishes, glasses, cups and eating utensils and to have sufficient detergent composition remain after washing during the rinsing of the washed dishes, glasses, cups and eating utensils to prevent the deposition of and remove traces or films.

2. The method of claim 1 wherein the detergent composition comprises a small effective amount of one or more detergent adjuvants as follows: anti-encrustation agent, bleaching agent, bleach activator, sequestering agent, anti-foam agent, optical brightener, enzymes and perfume.

3. The method of claim 1 wherien the detergent composition includes about 1.5 to 5 percent of a copolymer of methacrylic acid and maleic anhydride anti-encrustation agent.

4. The method of claim 1 wherein the detergent composition includes about 0.5 to 2.0 percent alkanol phosphoric acid ester anti-settling agent.

5. The method of claim 1 wherein the detergent composition includes about 5 to 20 percent acid terminated nonionic surfactant viscosity control and anti-gel agent.

6. The method of claim 1 wherein the detergent composition includes about 5 to 20 percent of an alkali metal citric acid or tartaric acid builder salt.

7. The method of claim 1 wherein the detergent composition includes about 5 to 30 percent of an alkali metal silicate builder.

8. The method of claim 1 wherein the detergent composition includes about 0.25 to 1.0 percent of an organic sequestering agent.

9. The method of claim 1 wherein the detergent composition includes about 0.25 to 1.0 percent of an anti-foam agent.

10. The method of claim 1 wherein the detergent composition includes about 10 to 20 percent sodium metasilicate.

11. The method of claim 1 wherein the detergent composition includes 0.5 to 2.0 percent enzyme.

12. The method of claim 1 wherein the detergent composition comprises

| | |
|---|---|
| liquid nonionic surfactant | 35–55% |
| alkali metal polyphosphate | 10–25% |
| alkali metal silicate | 5–15% |
| alkylene glycol mono alkyl ether anti-gel agent | 5–15% |
| alkali metal perborate | 2–4% |
| tetraacetyl ethylene diamine | 2–4% |

13. The method of claim 1 wherein the detergent comprises

| | |
|---|---|
| liquid nonionic surfactant | 35–55% |
| alkali metal polyphosphate | 10–25% |
| alkali metal citric acid or tartaric acid salt | 5–20% |
| alkali metal silicate | 5–15% |
| alkylene glycol mono alkyl ether anti-gel agent | 5–15% |
| alkali metal perborate | 2–4% |
| tetraacetyl ethylene diamine | 2–4% |

14. The method of claim 1 wherein the detergent composition comprises

| | |
|---|---|
| liquid nonionic surfactant | 30–40% |
| alkali metal polyphosphate | 25–35% |
| alkali metal silicate | 5–15% |
| alkylene glycol mono alkyl ether anti-gel agent | 5–15% |
| alkali metal citric acid or tartaric acid salt | 5–20% |
| alkanol phosphoric acid ester anti-settling agent | 0.5–1.5% |
| alkali metal perborate | 8–11% |
| tetraacetyl ethylene diamine | 3–5.5% |

15. A concentrated nonaqeuous liquid dishwashing composition which comprises a liquid nonionic surfactant detergent in an amount of about 30 to 60 percent an alkali metal polyphosphate detergent builder dispersed in the nonionic surfactant in an amount of about 10 to 40 percent a alkali metal citric acid or tartaric acid builder salt in an amount of about 5 to 20 percent an alkylene glycol mono alkyl ether anti-gel agent in an amount of about 5 to 15 percent said dishwashing composition being sufficiently concentrated to have a sufficient amount of detergent remain after the wash cycle to rinse dishes, glasses, cups and utensils and obtain dishes, glasses, cups and utensils that are free of undesirable traces or films.

16. The composition of claim 15 comprising an alkanol phosphoric acid ester anti-settling agent in an amount of about 0.25 to 2.0 percent.

17. The composition of claim 15 comprising a carboxylic acid terminated nonionic anti-gel agent in an amount of about 5 to 20 percent.

18. The dishwashing detergent composition of claim 1 wherein the composition comprises

| | |
|---|---|
| liquid nonionic surfactant | 35–55% |
| alkali metal polyphosphate | 10–25% |
| alkali metal citric or tartaric acid salt | 5–20% |
| alkali metal silicate | 5–15% |
| alkylene glycol mono alkyl ether anti-gel agent | 5–15% |
| alkali metal perborate | 2–4% |
| tetraacetyl ethylene diamine | 2–4%. |

19. The dishwashing detergent composition of claim 15 wherein the composition comprises

| | |
|---|---|
| liquid nonionic surfactant | 35–55% |
| alkali metal polyphosphate | 10–25% |

-continued

| | |
|---|---|
| alkali metal citric acid or tartaric acid salt | 5–20% |
| copolymer of methacrylic acid and maleic anhydride | 1.5–3% |
| alkali metal silicate | 5–15% |
| alkylene glycol mono alkyl ether anti-gel agent | 5–15% |
| alkanol phosphoric acid anti-settling agent | 0.25–1% |
| alkali metal perborate | 2–4% |
| tetraacetyl ethylene diamine | 2–4% |
| diethylene triamine pentamethylene phosphonic acid sodium salt | 0.25–1%. |

20. The dishwasher detergent composition of claim 1 wherein the composition comprises

| | |
|---|---|
| liquid nonionic surfactant | 30–45% |
| acid terminated nonionic surfactant viscosity control and anti-gel agent | 5–20% |
| alkali metal polyphosphate | 25–35% |
| alkali metal citric acid or tartaric acid salt | 5–20% |
| alkali metal silicate | 5–15% |
| alkylene glycol mono alkyl ether anti-gel agent | 5–15% |
| copolymer of methacrylic acid and maleic anhydride | 3–5% |
| alkanol phosphoric acid anti-settling agent | 0.5–1.5% |
| alkali metal perborate | 8–11% |
| tetraacetyl ethylene diamine | 3–5.5% |
| diethylene triamine pentamethylene phosphonic acid sodium salt | 0.25–1% |

21. The detergent composition of claim 15 which comprises a small effective amount of one or more detergent adjuvants selected from the group consisting of anti-encrustation agent, bleaching agent, bleach activator, sequestering agent, anti-foam agent, optical brightener, enzymes and perfume.

* * * * *